United States Patent [19]

Edwards, Jr.

[11] 4,012,087

[45] Mar. 15, 1977

[54] CARD INDEX BOX

[76] Inventor: Robert L. Edwards, Jr., 388 St. Mary's Parkway, Buffalo Grove, Ill. 60090

[22] Filed: July 21, 1975

[21] Appl. No.: 597,346

[52] U.S. Cl. ..... 312/183; 206/425; 206/565; 220/22.1

[51] Int. Cl.[2] ..... A47B 63/00; B65D 1/34

[58] Field of Search ..... 220/22.1, 22.4; 206/72, 206/13; 312/183, 184; 402/68; 211/11, 15

[56] References Cited

UNITED STATES PATENTS

| | | | |
|---|---|---|---|
| 833,269 | 10/1906 | Weis | 220/22.1 |
| 3,167,180 | 1/1965 | Kremp | 206/72 |
| 3,170,571 | 2/1965 | Knapp et al. | 206/72 |
| 3,224,824 | 12/1965 | Remke | 312/183 |
| 3,822,082 | 7/1974 | Mathiesen | 312/183 |

*Primary Examiner*—Casmir A. Nunberg
*Attorney, Agent, or Firm*—W. Melville Van Sciver

[57] ABSTRACT

This invention relates in general to card filing devices and more particularly to a card file case comprising a one piece receptacle for the cards to be filed with angled projections at the front and back of the receptacle which are an integral part thereof for retaining the cards in an angular position from the verticle.

5 Claims, 6 Drawing Figures

CARD INDEX BOX

BACKGROUND OF THE INVENTION 1. Field of the invention

The invention relates to index card filing devices. 2. Description of the Prior Art U.S. Pat. No. 833,269, Weis, shows a filing case with sides and ends flexibly connected with an up-turned rim attached to receive the bottom margin and sides and ends, the up-turned rim having apertures therethrough for fastening devices.

U.S. Pat. No. 1,228,743, Bredehoft, discloses a file box comprising a receptacle for the matter to be filed with a hinge secured to the receptacle and a closure slidably connected to the hinge, which closure is movable upwardly about the axes of the hinge and then downwardly transversely of the axes.

U.S. Pat. No. 1,821,245, Straubel, relates to spacer guides for use in file drawers operable for use in both verticle and inclined positions in drawers having either a stationary or expanded end panel.

U.S. Pat. No. 3,167,180, Kremp, discloses a transparency holder wherein the cover member serves as a cover when in closed position and also serves as a tray for the container member when in the open position, the container being disposed at an angle to the horizontal.

U.S. Pat. No. 3,224,824, Remke, refers to a card filing device consisting of a drawer and a cabinet, the drawer being provided with inclined abutments on opposite ends to assist in fanning of the cards.

U.S. Pat. Nos. 3,333,590 and 3,465,460, Dahl Jr., relate to card filing devices in which a magnetic force is utilized for fanning desired portions of a stacked array of cards to permit inspection of same.

SUMMARY OF THE INVENTION

The index invention makes use of very inexpensive one piece construction for card index files with provision to retain the cards in an angular position from the verticle. The index cards are separated by microfiche cards such as described in the U.S. Pat. No. to Dahl, Jr. U.S. Pat. No. 3,465,460 referred to above. One embodiment of the invention provides a simple retaining member at the bottom of the cards to afford ready removal or addition of cards to the file. It also provides for the cover being a holder for the container when in use.

BRIEF DESCRIPTION OF THE DRAWINGS

FIG. 1 is a perspective view of one embodiment of the card file case constructed in accordance with the invention with the cover on;

DESCRIPTION OF THE PREFERRED EMBODIMENT

Figure 1:
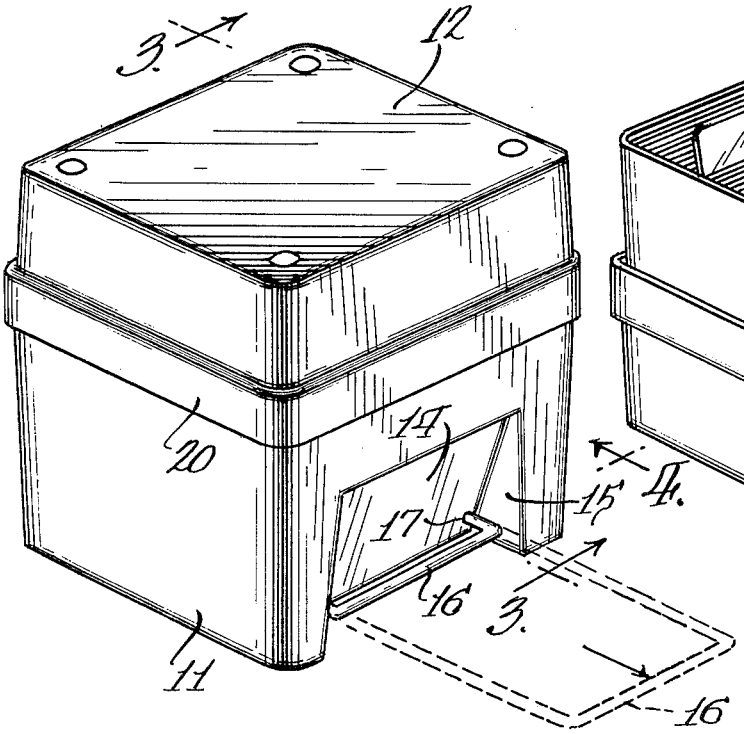
Figure 2:
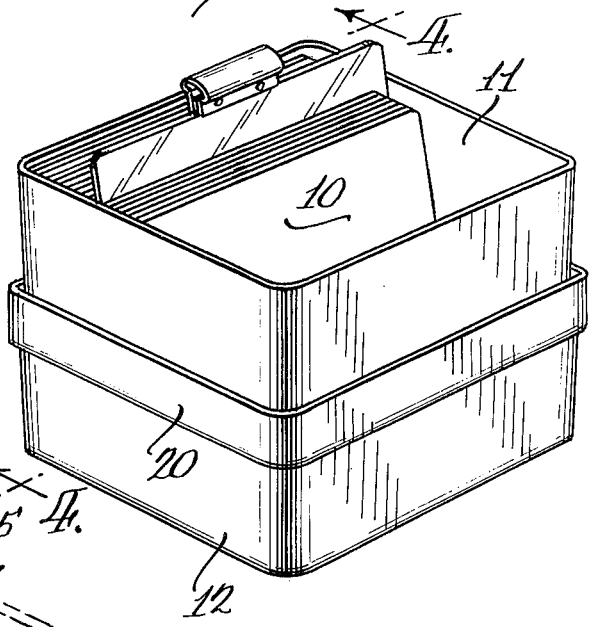
FIG. 2 is a perspective view of the card case with the case disposed inside the cover.
Figure 3:
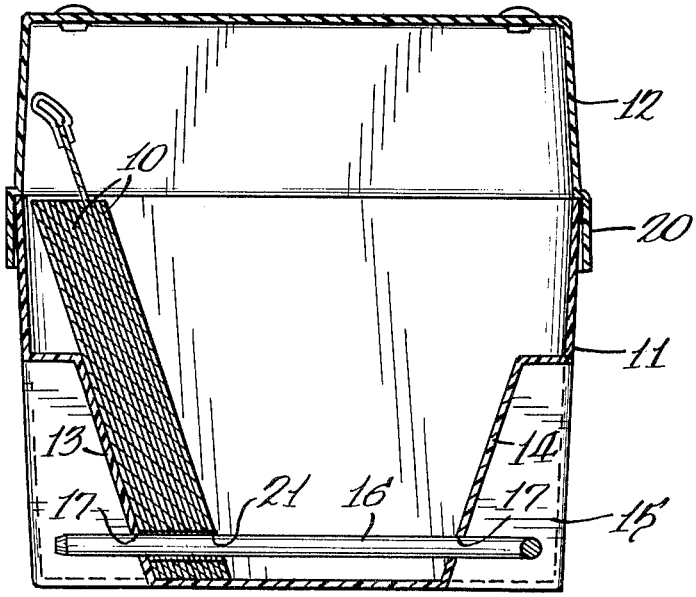
FIG. 3 is a sectional view of the card case taken on line 3—3 of FIG. 1.
Figure 4:
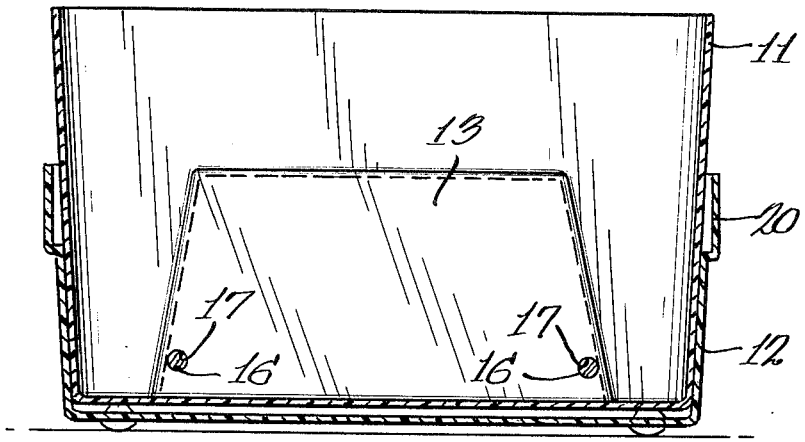
FIG. 4 is a sectional view taken on line 4—4 of FIG. 2.

Referring to FIGS. 1–4, index cards 10 are disposed in a generally rectangular container 11 which is preferably formed from one piece of plastic or similar material. A generally rectangular pan shaped cover 12, also of one piece of material, is provided for covering the cards when the file is not in use and is proportioned so that a flange 20 will receive the case 11 in the position shown in FIG. 2. As best shown in FIG. 3, inclined walls 13 and 14 are formed along part of the front and back of the bottom of the case 11 to support the cards 10 in the position inclined from the verticle. A wall 15 is thus formed in the case 11.

Apertures 17 are provided in the walls 13 and 14 adjacent the bottom thereof so that a retaining bail comprising a U-shaped rod 16 may be inserted in the apertures and extend through holes 21 at the bottom corners of the card 11. The retaining bail 16 is shown in its normal position in FIGS. 1 and 3 to retain the cards 10 in the case so that they will not accidentally fall out and as shown in dotted lines in FIG. 1 in the position in which the bail is placed when it is desired to remove or add to the cards 10 in the case.

Figure 5:
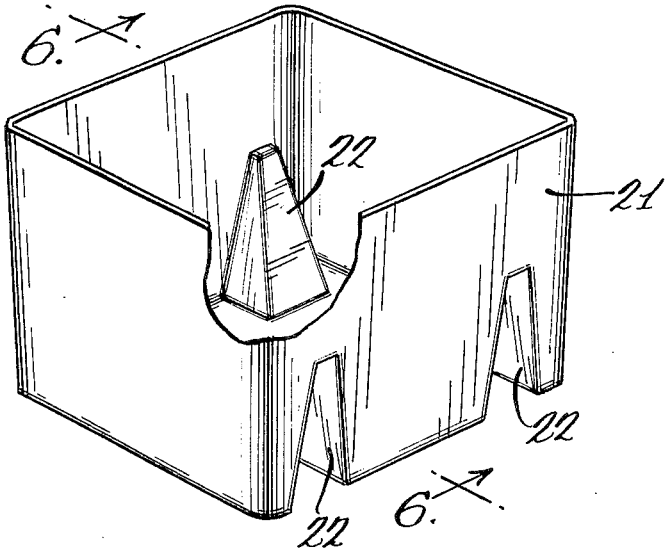
FIG. 5 is a perspective view of another embodiment of the card case.
Figure 6:
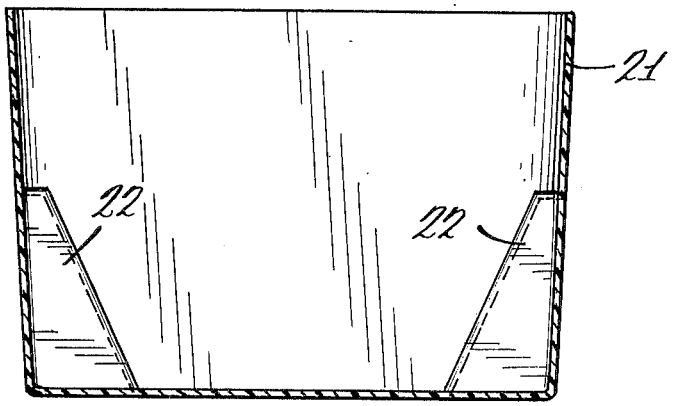
FIG. 6 is a sectional view taken on the line 6—6 of FIG. 5.

Referring to FIGS. 5 and 6 for description of the second embodiment of the invention, a case 21 is provided which has inclined pyramid-shaped abutments for the cards formed in the front and back walls of the case 21 so that the cards may be retained in an angular position for easy inspection. The case 21 in the abutments 22 are preferably formed in one piece from a plastic or other suitable material.

Both embodiments of the invention provide for a very inexpensive and practical card index container which retains the cards in an angular position for easy inspection.

I claim as my invention:

1. A card file case for containing separator cards and index cards therein comprising a one piece, generally rectangular receptacle including front and back verticle walls and means for retaining said cards in an angular position from the verticle, which means comprise inwardly angled projecting walls at the front and back of the receptacle which are an integral part of the receptacle, said projecting walls being formed by angled recesses in said front and back verticle walls.

2. A card file case as claimed in claim 1 in which a cover is provided for the receptacle, the cover being so dimensioned that the receptacle fits snugly inside of the receptacle when access to the cards is required.

3. A card file case as claimed in claim 2 in which a U-shaped bar is adapted to enter openings in the angled projection formed in said recesses and in the cards to retain said cards in the box and permit the addition or deletion of cards therefrom.

4. A card file case as claimed in claim 1 comprising a one piece receptacle for the cards to be filed and means for retaining said cards in an angular position from the verticle, which means comprises four projections at the front and rear of the receptacle extended inwardly of the receptacle and formed integrally therewith.

5. A card file case as claimed in claim 4 wherein the four projections are substantially pyramid-shaped.

* * * * *